United States Patent [19]

Rohr et al.

[11] 4,062,382

[45] Dec. 13, 1977

[54] EXTENDING CARRIER FOR LOOMS WITH REMOVAL OF THE FILLING YARN FROM STATIONARY BOBBINS

[75] Inventors: Willy Rohr, Hinwil; Lothar Kohler, Tann-Ruti, both of Switzerland

[73] Assignee: Ruti Machinery Works Ltd., Ruti, Switzerland

[21] Appl. No.: 726,006

[22] Filed: Sept. 23, 1976

[30] Foreign Application Priority Data

Sept. 24, 1975 Switzerland ..... 12385/75
May 25, 1976 Switzerland ..... 6549/76

[51] Int. Cl.[2] ..... D03D 47/18
[52] U.S. Cl. ..... 139/448
[58] Field of Search ..... 139/447, 448

[56] References Cited

U.S. PATENT DOCUMENTS 3,441,061 4/1969 Peracca et al. ..... 139/448
3,638,686 2/1972 Sole et al. ..... 139/448

FOREIGN PATENT DOCUMENTS 2,061,194 4/1972 Germany ..... 139/448

*Primary Examiner*—Henry S. Jaudon
*Attorney, Agent, or Firm*—Donald D. Denton

[57] ABSTRACT

An extending carrier for looms having a hook with a clamping tongue swingable perpendicular to the plane of the hook and having a control surface on the tongue having a deflection edge positioned on the side surface of the carrier which faces the point of formation of the shed of the loom, the point of the structural part which bears the deflection edge extending into the mouth of the hook.

5 Claims, 7 Drawing Figures

EXTENDING CARRIER FOR LOOMS WITH REMOVAL OF THE FILLING YARN FROM STATIONARY BOBBINS

BACKGROUND OF THE INVENTION

The present invention relates to an extending carrier for looms with removal of the filling yarn from stationary bobbins, having a hook with a clamping tongue which is swingable perpendicular to the plane of the hook, a control surface being developed on said clamping tongue, and a deflection edge being provided to keep the warp yarns from the control surface.

Extending carriers of this type are used in carrier looms and serve to grasp the filling thread which has been withdrawn from a stationary bobbin by an inserting carrier and introduced or inserted into approximately the center of the shed and then by use of an extending carrier, which takes the yarn from the inserting carrier, pulls it through the second half of the shed. After the emergence of the extending carrier from the shed, the filling thread is released.

In one known extending carrier of the aforementioned type, the filling yarn is clamped in a clamping slot formed by an edge of the clamping tongue and the adjacent inner edge of the hook. The outer edge of the hook serves as a guide edge for the filling yarn and upon the inward movement of the extending carrier into the area of the inserting carrier, conducts the filling yarn to the clamping slot, into which the filling yarn is further drawn upon the travel of the extending carrier out of the inserting carrier with the yarn then clamped fast in the extending carrier. For the additional guiding of the filling yarn as it slides along the outer edge of the hook there is provided an elongated guide element arranged on the side surface of the extending carrier which faces the point of the shed. This guide element lies in vicinity of its front end, against the outer edge of the hook and together with the latter forms an inlet funnel for the filling yarn.

In order to release the filling yarn from the clamping slot after the extending carrier has emerged from the shed, the clamping tongue must be swung perpendicular to the plane of the hook. This swinging is effected by a control member which is stationarily mounted on the loom and against which the control surface provided on the clamping tongue moves, whereby the clamping tongue is pressed downward and the filling yarn is released. The deflection edge is provided on the side surface of the extending carrier which faces away from the point of the shed and it protrudes over the control surface so that the warp yarns slide over the deflection edge without touching the control surface.

Since the deflection edge is developed on the side surface of the extending carrier which faces away from the point of the shed, and therefore at a place where the height of the shed is relatively large, the deflection edge must extend relatively high above the control surface and thus over the body of the carrier. This means a relatively large size for the surface bearing the deflection edge and thus a substantial increase in the weight of the extending carrier. The high weight of the extending carrier has the result that it can be driven only by rigid bars but not by flexible bands, and is thus a disadvantage.

Another disadvantage of the known extending carrier is that, due to the guide element resting on the outer edge of the hook, it has two points on its face surface, namely the hook point and the point of the guide element. Between these two points warp threads can be caught upon the entrance of the extending carrier into the shed and during its movement towards the center of the shed.

The closest prior art known to the applicants in connection with this application is the German patent 2,061,194.

SUMMARY OF THE INVENTION

The invention avoids the above disadvantages, and it is characterized by the fact that the deflection edge is positionally arranged on the side surface of the extending carrier which faces the point of the shed and that the point of the structural part bearing the deflection edge extends into the mouth of a hook.

Due to the fact that the deflection edge is now arranged on the side surface of the extending carrier which faces the point of the shed, and therefore at a place where the height of the shed is relatively slight, the deflection edge need not extend over the control surface. This means small dimensions and low weight for the surface bearing the deflection edge. Due to the fact that the point of the surface bearing the deflection edge extends into the mouth of the hook, the extending carrier has on its face side only one point and the catching of warp yarns on the two points of the extending carriers known in the art is eliminated. Despite the presence of only one point and the absence of the introduction funnel, the filling yarn is always reliably conducted into the clamping slot in a smooth and simplified manner.

BRIEF DESCRIPTION OF THE DRAWINGS

These and other objects will become apparent from the illustratibe embodiments as set forth in the accompanying drawings, in which.

DESCRIPTION OF PREFERRED EMBODIMENTS

Figure 1:
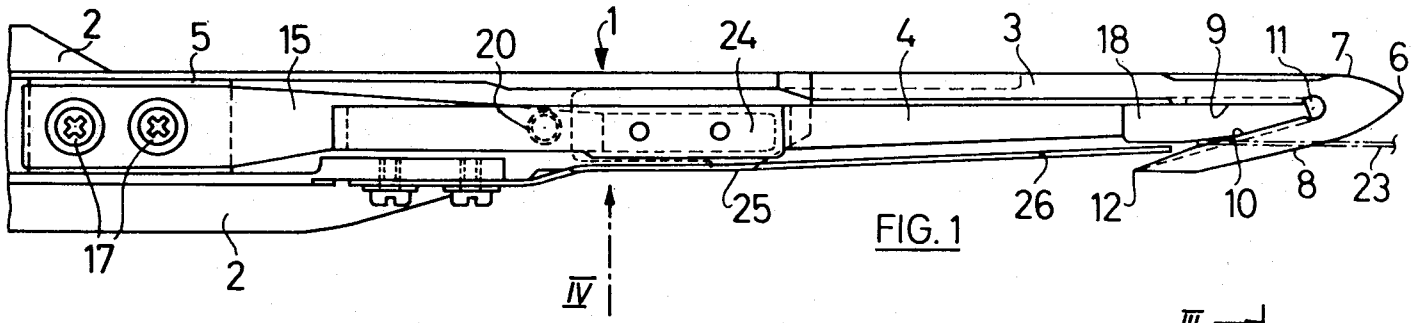
FIG. 1 is a top view of an extending carrier.
Figure 4:
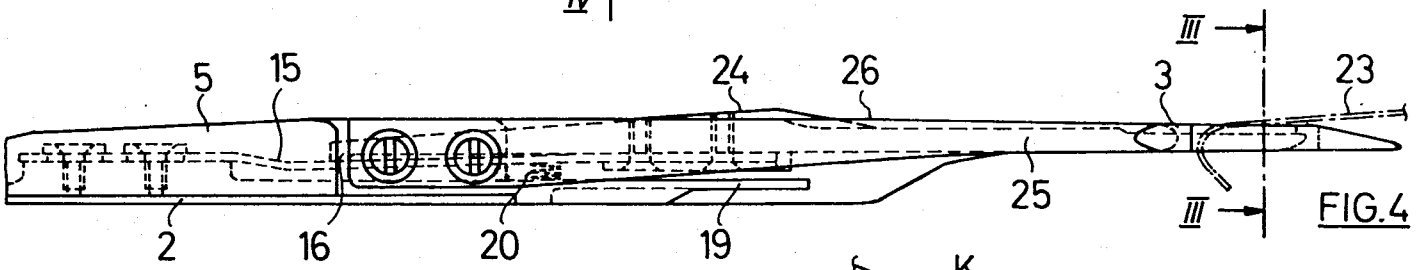
FIG. 4 is a side view in the direction of arrow IV in FIG. 1.

The extending carrier or taker-gripper 1 shown in the figures is mounted on the front end of a flexible band 2 of a carrier type loom which flexible band serves to drive it in its back and forth motion during the operation of the loom. The extending carrier comprises essentially an elongated flat hook 3 and an elongated flat and resilient clamping tongue 4. The clamping tongue 4 is so supported that it can be swung out perpendicular to the plane of the hook 3 in such a manner that the free end of the clamping tongue 4 swings below the plane of the drawing, as seen in FIG. 1.

Figure 3:
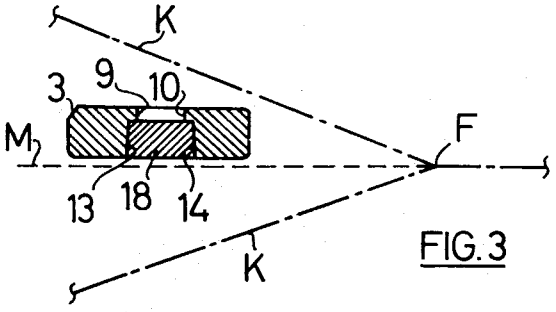
FIG. 3 is an enlarged cross-sectional view taken along the line III—III of FIG. 4.
Figure 2:
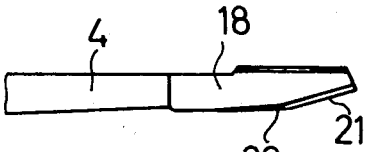
FIG. 2 is a top view of a detail of the clamping tongue of the extending carrier in FIG. 1.

The extending carrier 1 is introduced into the shed when the loom is operating from the left-hand side of the shed. The flexible band 2 and the plane of the hook 3 lie in this connection parallel to the central plane M of the warp yarns K. The warp yarns K, the central plane M thereof, and the point F of the shed are indicated diagrammatically in FIG. 3.

The hook 3 is developed on the carrier body 5 which is mounted on the flexible band 2 and has an approximately U-shaped cross section. The rear side wall of the gripper or carrier body 5 which faces away from the point F of the shed passes into the longer arm of the hook 3; the shorter arm of the hook 3 and the hook opening lie on the front side of the extending carrier 1, facing the point F of the shed. The outer edges 7 and 8 of the two hook arms terminate in the hook point 6; the inner edges 9 and 10 of the two hook arms define the hook jaw 11. The end of the hook is designated 12. The inner edges 9 and 10 of the two hook arms are each provided with a step 13, 14, so that the hook jaw 11 is narrower on the top of the hook than on the bottom of the hook.

The clamping tongue 4 is clamped in the region of the one end thereof which faces away from the point 6 of the hook; its other end 18 extends into the jaw 11 of the hook, and specifically into its wider part at the bottom of the hook. The rear longitudinal edge of the end 18 of the clamping tongue, facing away from the point F of the shed, serves as guide edge while the front longitudinal edge facing the point F of the shed, together with the step 14 of the inner edge 10 of the hook, forms a clamping slot for a filling yarn 23. The end 18 of the clamping tongue 4 is beveled on its front longitudinal edge and has a clamping surface 22 of smaller slope for thicker yarns and a clamping surface 21 of larger slope for thinner yarns. These two clamping surfaces can pass smoothly into each other.

In addition to this, the clamping tongue 4 has a trapezoidal cross section in the region of its end 18, and the inner edges 9 and 10 of the hook are developed correspondingly wedge shaped in the region of their steps 13 and 14. In this way, a double wedging action is produced in the clamping slot, as a result of which the filling yarn 23, on the one hand, is always reliably clamped fast while, on the other hand, it is also rapidly released upon the loosening of the clamp.

In the embodiment shown in FIGS. 1 to 4, the clamping tongue 4 is screwed, approximately at its center, to a leaf spring 15 and at its one end has a projection 16. By means of the projection 16 the clamping tongue 4 rests against the leaf spring 15. The leaf spring 15 is attached by screws 17 to the carrier body 5 and has such an initial tension that the end 18 of the clamping tongue 4 is pressed upwards against the step in the jaw 11 of the hook. This initial tensioning of the leaf spring 15 is supported by a spiral spring 20 acting between the bottom 19 of the carrier body 5 and the leaf spring 15.

Figure 5:
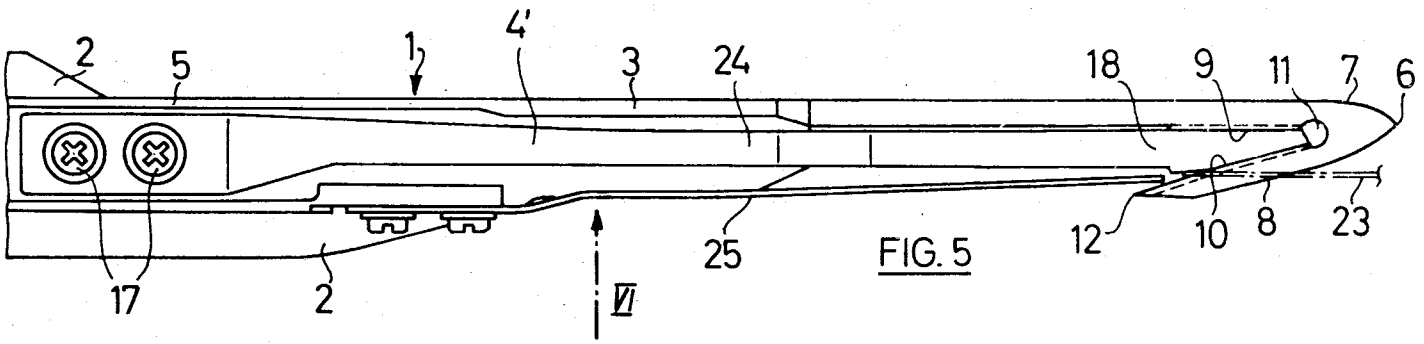
FIG. 5 is a variant of a detail of the extending carrier set forth in FIG. 1.
Figure 6:
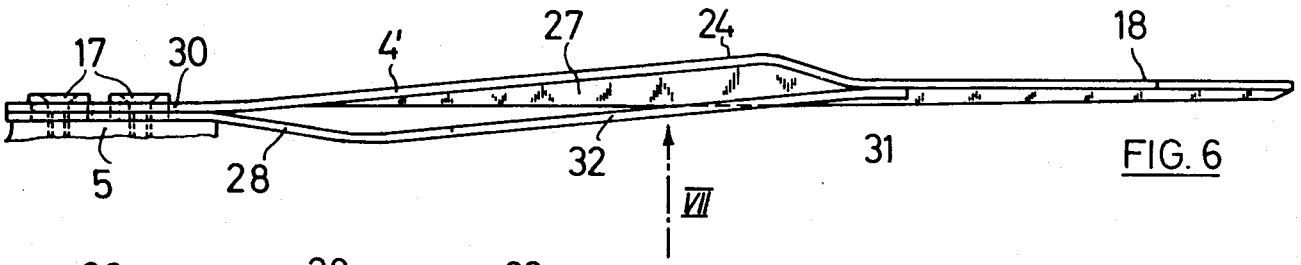
FIG. 6 is a side view of a detail seen in the direction of the arrow VI of FIG. 5.
Figure 7:
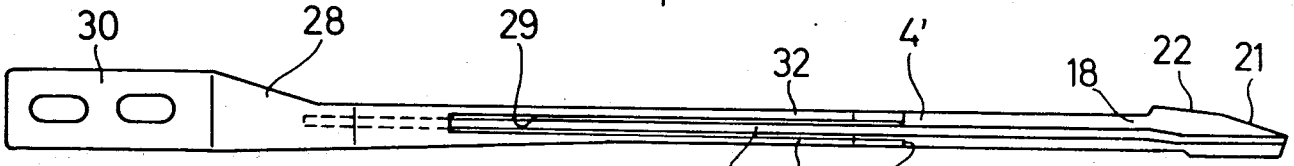
FIG. 7 is a view of a detail seen in the direction of arrow VII in FIG. 6.

In the embodiment shown in FIGS. 5 through 7, the leaf spring 15 of FIG. 1 has been omitted and the clamping tongue 4 extends from the carrier body 5 to the jaw 11 of the hook. While FIG. 5 shows a top view of an extending carrier or taker gripper 1, FIGS. 6 and 7 each shows a view of a clamping tongue 4', the other parts of the carrier having been omitted in order to make the showing clearer.

The clamping tongue 4' is made in a single piece, for instance forged, and it attached at its one end by screws 17 to the carrier body. At its bottom, the clamping tongue 4' is provided with a stiffening rib 27 which extends in longitudinal direction. The clamping tongue 4' has such an initial tension that its other end 18 is pressed upward against the step in the jaw 11 of the hook. This initial tension can be supported by a leaf spring 28 which is clamped at its one end 30 between the clamping tongue 4' and the carrier body 5 and presses from below against the clamping tongue 4'. The leaf spring 28 is provided against its other end 31 with a longitudinal slot 29 and has therefore two longitudinal fingers 32 and 33 and is fixed against transverse displacement by means of said slot on the stiffening rib 27.

In both of the embodiments of the extending carrier shown, the clamping tongues 4 and 4' must be acted on by a downwardly acting force in order to loosen the clamp after the insertion of the filling yarn 23 in order for the end 18 to swing downward. For this purpose, the cover surface of the clamping tongues 4 and 4' are provided, approximately in the center between the screws 17 and the jaw 11 of the hook, with a control surface 24 which ascends in wedge shape. Upon the emergence of the point 6 of the hook, and thus of the filling thread 23 cut of the shed, the control surface 24 moves into contact with a release element or means which may be in the form of a camming surface (not shown) which is mounted in fixed position on the loom and thereby causes a downward swinging movement of the clamping tongue 4. The amplitude of this swinging motion is limited in downward direction by the bottom 19 of the carrier body 5.

Upon the weaving of heavy fabrics, it might happen that the pressure of the warp yarns in the shed on the control surface 24 is itself sufficient to swing the clamping tongue 4 downwards. In order to prevent this, an elongated leaf spring 25 is screwed onto the front side wall of the carrier body 5 facing the point F of the shed, the front end of said spring extending into the mouth of the hook. The upper edge 26 of the leaf spring serves as deflection edge for the warp yarns and spaces the latter from the control surface 24. As clearly seen in FIG. 2, deflecting edge 26 does not extends as far vertically as does control surface 24 and yet said edge acts to deflect the ways away from said surface. This possible due to the line of divergance of the warp away from point F combined with locating the deflecting element on the side wall of the carrier body facing said point F.

Instead of the leaf spring 25, a rigid structural part can also be used to support the deflection edge 26. For example, the front side wall of the body 5 can be extended into the inside of the jaw 11 of the hook in which case there must be a gap, which assures free passage of the filling yarn, present between the front end of said elongated side wall and the inner edge 10 of the shorter arm of the hook.

The holes in the leaf spring 15 (FIGS. 1 to 4) or in the clamping tongue 4' and leaf spring 28 (FIGS. 5 to 7) through which the screws 17 pass are developed as widened slotted holes so that the clamping tongue 4 can be adjusted both in longitudinal direction and in transverse direction.

The manner of operation of the extending carrier 1 is as follows: The carrier 1 is transported by its band 2 from the left side of the loom to approximately the center of the shed and there in the region of the point 6 of the hook by means of the hook edge 8 comes against the filling thread 23 which is offered by an inserting carrier or bringer-gripper (not shown) in a position extending perpendicular to the plane of the hook 3. The extending carrier moves into the inserting carrier. In this connection, the filling yarn 23 which is still held fast by the inserting carrier slides over the edge 8 and the end 12 of the hook towards the clamping slot. Upon the outward movement of the extending carrier, the filling yarn 23 enters the clamping slot, namely up to the zone which corresponds to its thickness. At this moment, the clamp in the inserting carrier loosens, and the filling yarn which is now clamped fast by the extending carrier is drawn by the latter through the second half of the shed to complete the lay-in of a filling thread. After the insertion has been effected, the clamp in the extending carrier is released in the manner already described.

It will be appreciated that the extending carrier, due to its compactness, is particularly suitable for use on looms in which flexible bands of the type shown in the figures of the drawings are used as carrier drives. Of course, the extending carrier can also be used on rigid insertion bars.

It will be further appriciated that various changes and/or modifications may be made within the skill of the art without departing from the spirit and scope of the invention illustrated, described, and claimed herein.

What is claimed is:

1. Extending carrier for looms with removal of the filling yarn from stationary bobbins, said carrier having a hook with a clamping tongue swingable perpendicular to the plane of the hook, a control surface being developed on said clamping tongue, said carrier having further a deflection edge for keeping the warp yarns away from the control surface, said deflection edge arranged on the side surface of said carrier which faces the point of formation of the shed, and the point of the structural part which bears the deflection edge extending into the mouth of the hook.

2. The extending carrier according to claim 1 in which the structural part which bears the deflection edge is formed of a leaf spring which is fastened to the body of the carrier.

3. The extending carrier according to claim 2 in which the point of the leaf spring rests resiliently against the inner edge of the arm of said hook which faces the point of formation of the shed.

4. The extending carrier according to claim 1 in which the clamping tongue is fastened to the body of the extending carrier and extends as a single piece in the longitudinal direction of the carrier up into the jaw formed by the hook and the clamping tongue is provided on its bottom with a stiffening rib which extends in longitudinal direction.

5. The extending carrier according to claim 4 in which a leaf spring which presses from the bottom against the clamping tongue is fastened to the body of the extending carrier, said leaf spring having a longitudinal slot and being fixed by means of said slot on said stiffening rib.

* * * * *